US005838108A

United States Patent [19]

Frank et al.

[11] Patent Number: 5,838,108

[45] Date of Patent: Nov. 17, 1998

[54] METHOD AND APPARATUS FOR STARTING DIFFICULT TO START ELECTRODELESS LAMPS USING A FIELD EMISSION SOURCE

[75] Inventors: Jerome D. Frank, Silver Spring; Charles H. Wood, Rockville; Miodrag Cekic, Silver Spring, all of Md.

[73] Assignee: Fusion UV Systems, Inc., Gaithersburg, Md.

[21] Appl. No.: 696,706

[22] Filed: Aug. 14, 1996

[51] Int. Cl.[6] ..... H01J 65/04

[52] U.S. Cl. ..... 315/39; 315/248

[58] Field of Search ..... 315/39, 248, 267, 315/344

[56] References Cited

U.S. PATENT DOCUMENTS

| | | | |
|---|---|---|---|
| 4,095,142 | 6/1978 | Murayama et al. | 135/248 |
| 4,247,800 | 1/1981 | Proud et al. | 315/39 |
| 4,328,445 | 5/1982 | Van Den Plas et al. | 315/46 |
| 4,710,679 | 12/1987 | Budinger et al. | 315/58 |
| 4,761,548 | 8/1988 | Laul | 315/150 X |
| 4,777,399 | 10/1988 | Miyazaki et al. | 313/54 |
| 4,890,042 | 12/1989 | Witting | 315/248 |
| 4,894,589 | 1/1990 | Borowiec | 315/248 |
| 4,902,937 | 2/1990 | Witting | 315/248 |
| 4,959,592 | 9/1990 | Anderson et al. | 315/248 |
| 4,982,140 | 1/1991 | Witting | 315/248 |
| 5,032,757 | 7/1991 | Witting | 313/44 |
| 5,047,693 | 9/1991 | Roberts et al. | 315/248 |
| 5,084,654 | 1/1992 | El-Hamamsy et al. | 315/248 |
| 5,095,249 | 3/1992 | Roberts et al. | 315/248 |
| 5,103,140 | 4/1992 | Cocoma et al. | 315/248 |
| 5,118,996 | 6/1992 | El-Hamamsy et al. | 315/248 |
| 5,140,227 | 8/1992 | Dakin et al. | 315/248 |
| 5,151,633 | 9/1992 | Farrall et al. | 315/248 |
| 5,153,484 | 10/1992 | El-Hamamsy | 315/248 |
| 5,157,306 | 10/1992 | Witting | 315/248 |
| 5,175,476 | 12/1992 | Anderson et al. | 315/248 |
| 5,187,412 | 2/1993 | El-Hamamsy et al. | 315/248 |
| 5,306,987 | 4/1994 | Dakin et al. | 315/248 |
| 5,331,254 | 7/1994 | Cocoma et al. | 315/248 |
| 5,367,226 | 11/1994 | Ukegawa et al. | 315/39 X |
| 5,479,072 | 12/1995 | Dakin et al. | 313/638 |
| 5,504,391 | 4/1996 | Turner et al. | 313/570 |

FOREIGN PATENT DOCUMENTS

| | | |
|---|---|---|
| 0 698 914 A1 | 2/1996 | European Pat. Off. . |
| 7-254391 | 10/1995 | Japan . |
| WO 93/21655 | 10/1993 | WIPO . |
| WO 94/08439 | 4/1994 | WIPO . |

*Primary Examiner*—Benny T. Lee
*Attorney, Agent, or Firm*—Shlesinger Arkwright & Garvey

[57] ABSTRACT

An electrodeless lamp comprises an envelope containing a fill; a starting electrode in proximity to a given region of the envelope when lamp is started; a field emission source disposed inside the envelope at the given region; starting power source coupled to the electrode for applying an electric field to the field emission source to cause a discharge; and excitation power source coupled to the fill to sustain the discharge. A method for starting an electrodeless lamp is also disclosed, comprising the steps of providing bulb comprised of an envelope and a discharge forming fill in the envelope; providing a field emission source on an interior surface of the envelope at a given region; applying an electric field at the given region to cause field emission from the field emission source to cause a discharge; and coupling a power source to the fill to sustain the discharge.

33 Claims, 8 Drawing Sheets

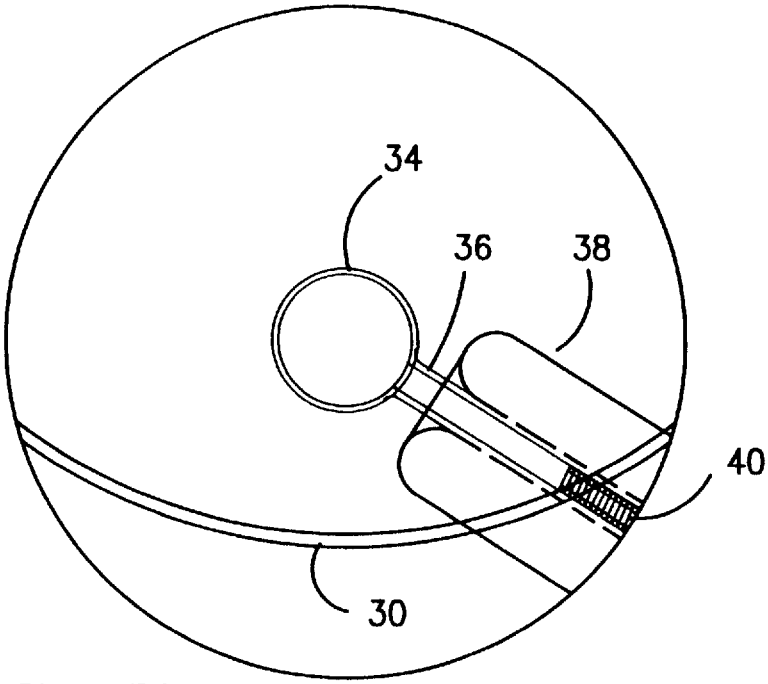
FIG. 7
FIG. 8A
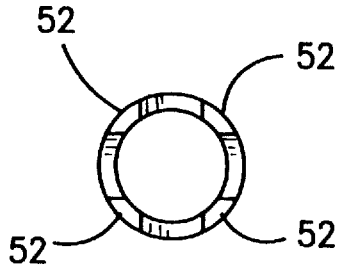
FIG. 8B
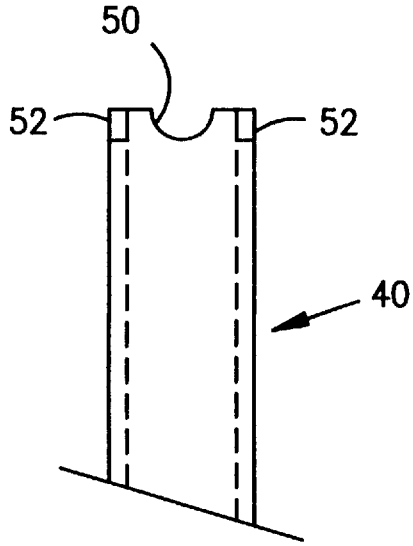

METHOD AND APPARATUS FOR STARTING DIFFICULT TO START ELECTRODELESS LAMPS USING A FIELD EMISSION SOURCE

The present invention is directed to starting electrodeless lamps which are difficult to start, such as high pressure electrodeless lamps and/or those containing electronegative fills.

FIELD OF THE INVENTION

Electrodeless lamps are typically powered with microwave or R. F. power. Some of the applications for such lamps include ultraviolet curing, semiconductor processing, lighting, and projection.

BACKGROUND OF THE INVENTION

Inasmuch as electrodeless lamps do not contain electrodes, they are usually more difficult to start than electroded lamps. One reason for this is that the high fields surrounding an electrode can easily provide the required ionization to start the electroded lamp. Of course, an electrodeless lamp does not have the benefit of such electrodes to aid starting.

Furthermore, there is a class of electrodeless lamps which are particularly difficult to start. This includes lamps where the bulb fill is present at high pressure at room temperature, including pressures of at least one atmosphere, and/or where the fill includes electronegative materials. In order to start the lamp, an electric field which is applied must cause ionization of the fill to occur. However, if the fill is at a high pressure, it will not ionize as easily as the air which surrounds the bulb. Thus, the surrounding air will break down first causing a short circuit to the bulb, and the full field will never be applied to the fill.

Fills which contain electronegative material are difficult to start because ionization of the fill requires the presence of free electrons. However, the electronegative materials act as a sink for such free electrons, thus making ionization difficult. Those fills which are both present at a high pressure and contain electronegative materials are particularly difficult to start.

In the prior art, various schemes have been set forth to improve lamp starting, but in general, these do not relate to lamps which are as difficult to start as those with which the present invention is concerned. For example, PCT Publication No. WO 93/21655, in the context of a sulfur or selenium lamp, discloses the addition of substances such as cesium to improve starting. However, in the PCT Publication, such substances are not used in a way which would start the class of lamps with which the present invention is concerned.

The present invention provides a solution in which difficult to start fills are started in a practical manner. The invention is applicable to difficult to start fills in general, and in particular, to the starting of high pressure excimer forming fills.

SUMMARY OF THE INVENTION

In accordance with an aspect of the invention, a method of starting an electrodeless lamp is provided wherein a bulb comprised of an envelope and fill is provided, a field emission source is disposed in the interior of the envelope at a given region, an electric field is applied at the given region of the envelope which is sufficient to cause field emission from the field emission source, and microwave or R. F. power is coupled to the fill which is sufficient to maintain a discharge.

The invention will be better understood by referring to the accompanying drawings wherein:

FIG. 7 is a detail of the sidearm which extends from the bulb.

FIG. 8A is an end view of the electrode shown in FIG. 7.

FIG.8B is a side view of the electrode shown in FIG. 8A.

DETAILED DESCRIPTION OF THE INVENTION

Figure 1:
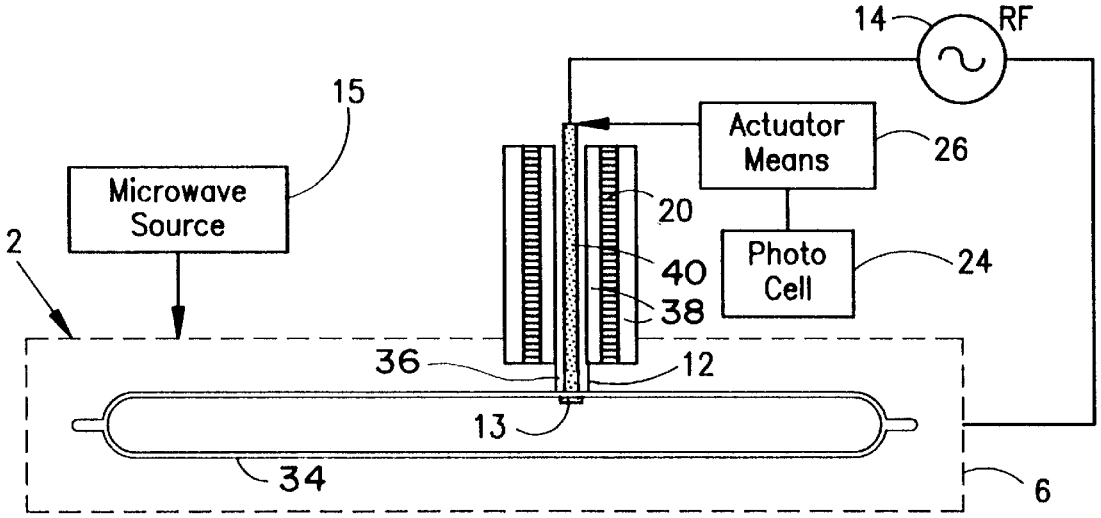
FIG. 1 is a schematic representation of an embodiment of the invention.

For simplicity of description, note that identical reference numerals shown in the different figures refer to identical items.

Referring to FIG. 1, electrodeless lamp 2 is shown, which in the embodiment depicted, is powered by microwave energy from source 15. Envelope 4 contains a discharge forming fill, and is located in microwave enclosure 6, which is schematically shown. In the preferred embodiment, enclosure 6 is a microwave chamber or cavity comprised of a reflector, and a mesh which is transparent to the radiation emitted by the fill, but which is substantially reflective to microwave energy.

In addition to the microwave energy, it is conventional to apply auxiliary energy to start the lamp. For example, a small ultraviolet lamp irradiating the fill may be used for this purpose. In lamps which are harder to start, it is known to use an auxiliary electrode which is powered by R. F. energy. However, even with such auxiliary sources, there is a class of lamps which resist starting. Two examples in this class are electrodeless lamps with relatively high pressure fills, and/or those with fills which contain electronegative species.

In the embodiment of FIG. 1, a starting system is depicted which is made up of a combination of elements which work together to provide effective starting of the class of lamps with which the present invention is concerned. A field emission source, e.g., a compound with a cation or element selected from the group of cesium, potassium, rubidium, and sodium is contained in the envelope, and means are provided for ensuring that the field emission source is present at a given region of the envelope.

A starting electrode, is provided for applying a high electric field at the given region of the envelope of sufficient magnitude to cause field emission from the field emission source, whereby sufficient number of free electrons are generated, to initiate the starting process of the lamp.

A "field emission source", as used herein, is a substance having a relatively low surface potential barrier which is capable of evolving electrons by field emission when subjected to an electric field of sufficient magnitude. Field emission is defined as the emission of electrons from the surface of a condensed phase into another phase, under the action of high (>0.3 V/angstrom) electrostatic fields. The phenomena consists of the tunneling of electrons through the deformed potential barrier at the surface. Thus, it differs fundamentally from the more standard forms of electron evolution in vacuum devices, thermionic and photoelectric emission; in both of these techniques, only the electrons with sufficient energy to go over the surface potential barrier are ejected.

While substances including cesium are disclosed in above-mentioned PCT Publication No. 93/21655 as being added to the fill, they are not used as field emission sources. They are not localized to a given region of the bulb and the field applied is not intense enough to result in field emission, a process which results in the production of substantial numbers of free electrons.

Referring again to FIG. 1, probe 40 is provided which extends through an opening 102 (see FIG. 9) in the microwave cavity wall (reflector 30), so that its tip 12 is in the proximity of envelope 34. In the preferred embodiment, tip 12 actually contacts the envelope wall so as to prevent the arcing which could occur if an air gap were present.

A series of R. F. pulses from R. F. oscillator 14 is provided to the probe at starting. The probe is surrounded by insulation means to prevent arcing between the probe and the wall of the microwave cavity and/or the bulb. In the preferred embodiment of the invention, the insulation means includes a quartz, heavy wall capillary tube, called the sidearm 36, an insulating gas 20 such as sulfur hexafluoride ($SF_6$), which is contained in the toroidal insulating jacket 38.

The field emission source 13 is disposed on the interior of the envelope, at a region under the probe known as the bulkhead. The substance is initially provided at this region by putting the substance in the fill, heating the envelope enough to cause the substance to decompose or sublimate, then by preferential cooling, cause the material to condense at the bulkhead region. This may be accomplished before the bulb is placed in the lamp. The electric field applied by the probe is of sufficient magnitude to cause field emission of electrons from substance 13. The electrons in combination with the electric field from the probe, and the microwave field, start the lamp. In the preferred embodiment, the R. F. pulse is applied in synchronism with the peak of the microwave field.

After the lamp starts, the R. F. power is removed from the probe. The probe is then retracted away from the lamp envelope and out of the interior of the cavity, so as to prevent puncture and interference with microwave fields in the cavity. To accomplish this, photodetector 24 detects the light emitted from the lamp, and after the signal is processed, it is fed to an actuator 26 which includes retraction means for retracting the probe.

After the lamp has been used for its intended purpose, it will be turned off by removing the microwave power. When the lamp is off, it is essential to ensure that the field emitting source is at the bulkhead region, so that when the lamp is next started, it will be available at this region where the starting electric field is applied. This may be accomplished either by arranging for the bulkhead to be the coolest region of the envelope, thus, promoting condensation of the field emitting source at this location, or by gravity, i.e., by arranging for the bulkhead to be the lowest region in the envelope.

It is noted that substances other than those described above may be used as field emission sources. For example, silicon carbide or carbon may be deposited on the interior of the envelope at the bulkhead by methods including inter alia, simple additions to the fill, chemical vapor deposition, and ion implantation.

It should further be noted that while FIG. 1 depicts an electrodeless lamp which is powered by microwave energy, the invention may be utilized as well, with electrodeless lamps which are powered by R. F. energy. Also, while a linear lamp bulb is shown, a variety of shapes may be used.

Figure 2:
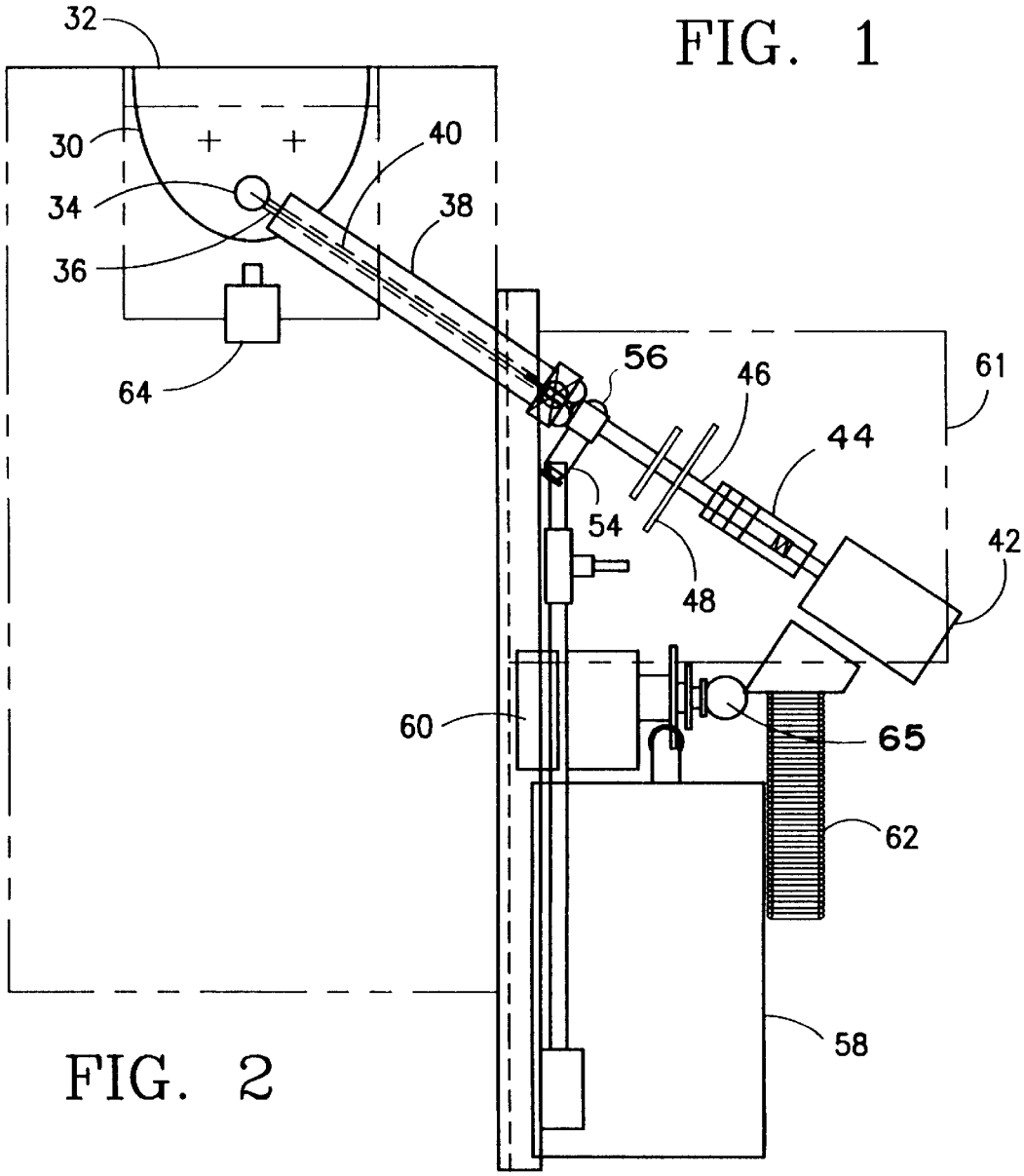
FIG. 2 is a side view of an embodiment of the invention.
Figure 3:
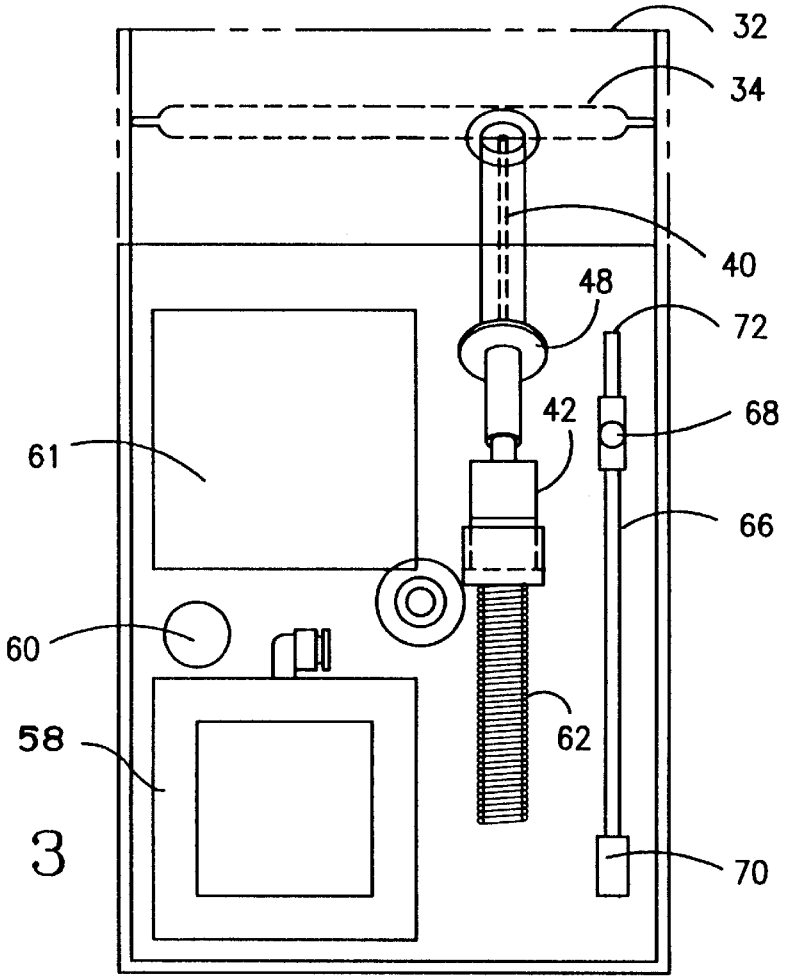
FIG. 3 is a front view of the embodiment show in FIG. 2.
Figure 4:
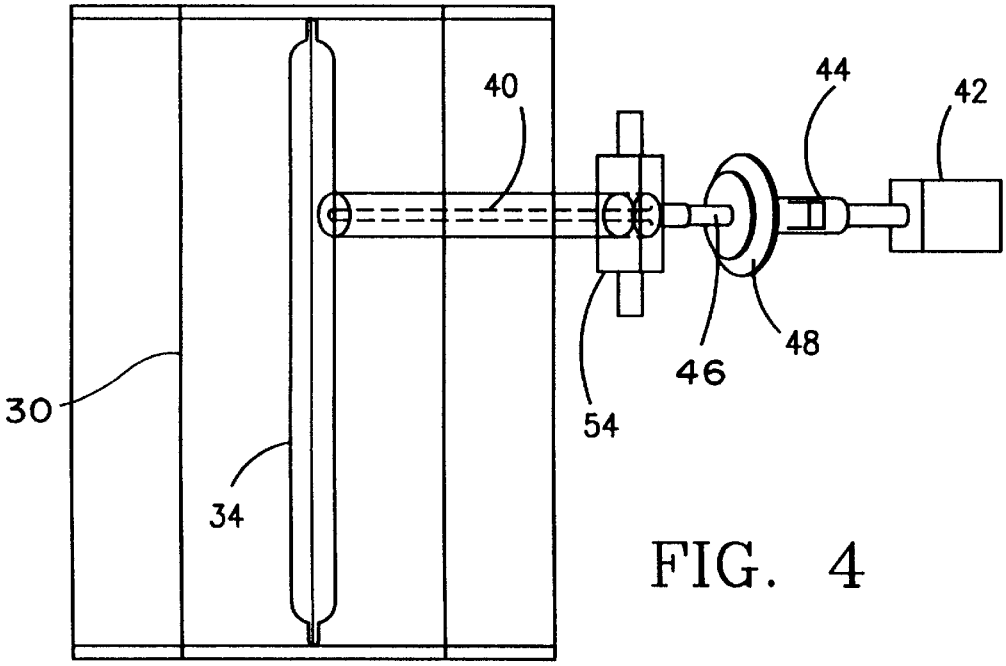
FIG. 4 is a top view of the embodiment shown in FIG. 2.

Referring to FIGS. 2 and 3, a microwave lamp is depicted having a cavity which is comprised of metallic reflector 30 (see FIG. 2) and metallic screen 32, which is substantially reflective to microwaves, but substantially transparent to ultraviolet radiation. Bulb 34 is located in the cavity and has a fill therein which is difficult to start as described above.

As in FIG. 1, a field emission source is located in the interior of the envelope at the bulkhead region. The bulkhead region has a sidearm 36 extending therefrom, which is more clearly shown in FIG. 7. Both the envelope and the sidearm may be made of quartz. Surrounding the sidearm and concentric therewith is a stationary toroidal jacket 38 (see FIG. 2) which contains an insulating gas. In the preferred embodiment, the insulating gas is sulfurhexafluoride ($SF_6$).

The electrode or probe 40 moves within the stationary sidearm/insulating gas tube structure. When in the lamp starting mode the probe is in an extended position with the tip contacting the bulb envelope. In some embodiments, it may only be necessary for the electrode to be in proximity to the bulb; however, for more critical starting applications where a high starting electric field is applied, it is necessary for positive contacting to be achieved.

Figure 5:
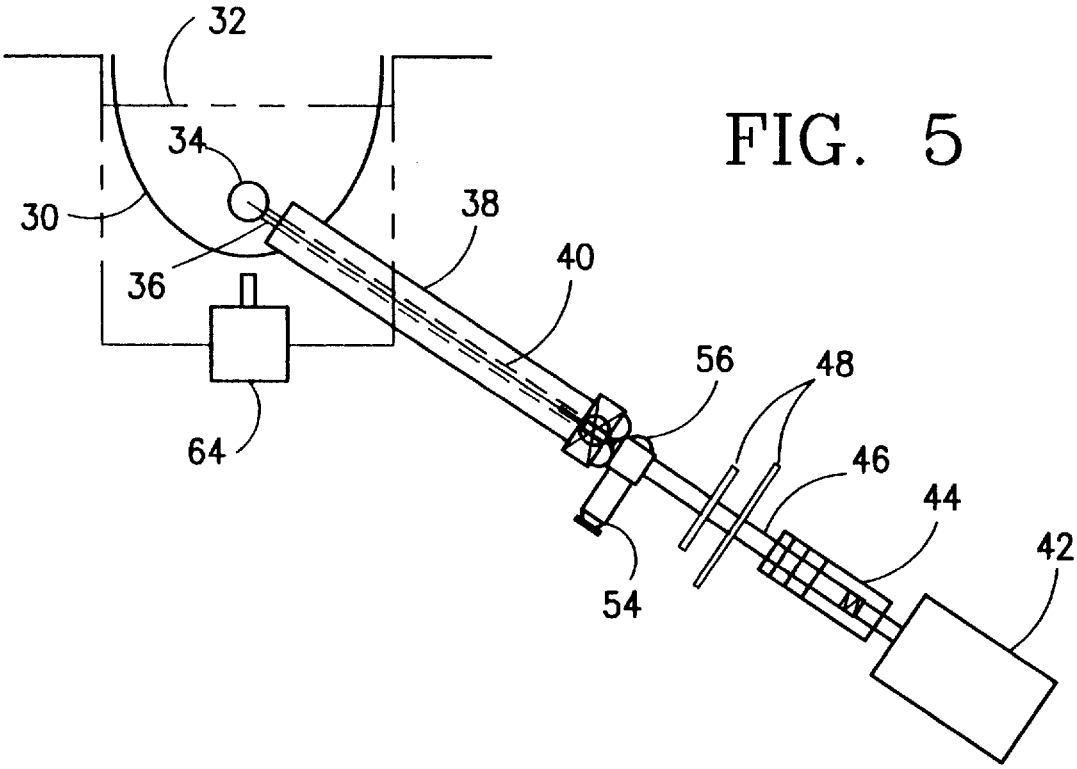
FIG. 5 shows the electrode in its extended position.
Figure 6:
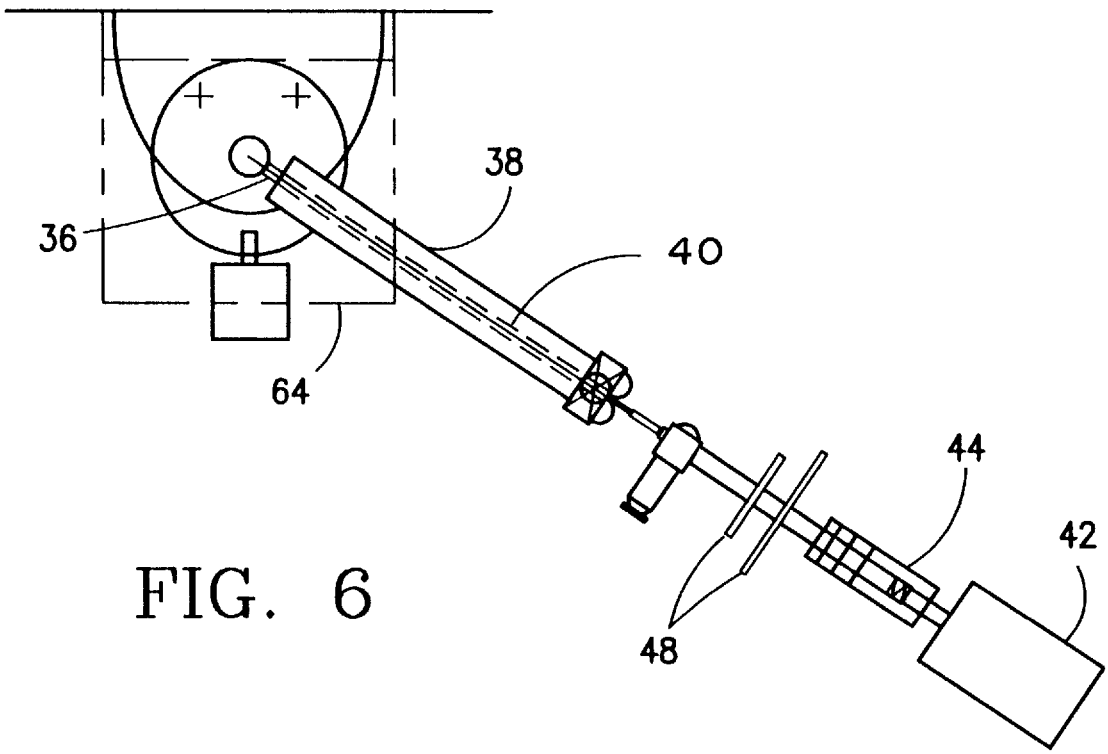
FIG. 6 shows the electrode in its retracted position.

The extended position of the electrode is seen most clearly in FIG. 5, while the retracted position is shown in FIG. 6. In the retracted position of FIG. 6, the electrode tip is about flush with the cavity wall. It is desirable to remove the electrode as much as possible from the space bounded by the cavity wall, since it functions as an antenna, and will disrupt the proper coupling of microwave power to the bulb.

Referring to FIGS. 5 and 6, the electrode is moved by air cylinder 42. This is of the type which either exerts a pressure in one direction to cause electrode insertion, or in the opposite direction to cause electrode retraction. The air cylinder acts through spring-loaded telescoping joint 44 which is arranged to provide positive probe contact on the bulb with minimum pressure. Cylindrical member 46, made of insulating material connects with the electrode and transfers the motion begun by the air cylinder thereto. Insulating fins 48 may be made of a composite, such as glass-epoxy, high pressure composite known as G-10 (trademark).

The bulkhead area is cooled at all times during operation by cooling air from air jet 64 as best shown in FIG. 2. Additionally, the electrode 40 is hollow, and cooling fluid, e.g., pressurized air is fed therethrough during starting, which cools the bulkhead and sidearm. The electrode is shown in greater detail in FIGS. 8A and 8B wherein the dotted lines represent the inside wall. The electrode has an opening 50 at the end and has a number of openings 52 in the sidewall near the probe tip, which allows the air to escape when the tip contacts the bulb envelope. An additional advantage of feeding air through the hollow electrode is that corona induced electrode damage is minimized by the rapid removal of ionization products from the area. This also has the advantage of allowing the electrode to be made of a less refractory material, e.g. stainless steel.

Referring to FIG. 5, a fitting 54 is provided as the air inlet for the pressurized air to the electrode. Region 56 on the back side of this fixture is the point of contact for the high voltage which is supplied to the electrode.

Thus, in the operation of the device, to start the lamp, the air cylinder 42 is activated which, through the spring loaded joint 44, moves insulating member 46, which is attached to the electrode. After the voltage is removed from the probe, it is retracted by further activation of air cylinder 42 in the opposite direction. The electrode is surrounded by an insulation system to prevent arcing between the electrode and the wall of the microwave cavity. In the preferred embodiment of the invention, a heavy wall quartz tube (sidearm) 36, is butt welded to the outer wall of the bulb. The tube serves not only as the first layer of the insulation system, but it provides positive mechanical alignment for the electrode and a long creep path length. A torroidal jacket 38, is fit over the sidearm 36. In the preferred embodiment of the invention, the jacket is filled with an insulating gas such as sulfur hexafluoride ($SF_6$). The insulating medium could also be a solid, such as a ceramic (alumina), polymeric solid (PTFE), polymeric fluid such as perflourinated polyether, fluid (ultra pure distilled water), or quenching gases such as chlorine or carbon monoxide. In a further embodiment, to provide insulation, the entire apparatus may be immersed in UV transparent, high dielectric strength fluid. The electrode 40, sidearm 36 and jacket 38, coaxially aligned, penetrate the microwave cavity 2. At the point of penetration 102 (see FIG.9), the cavity edge is contoured such that the edge radius is sufficiently large to reduce the electric field stress at the point of penetration. This prevents corona damage to the jacket. The main cooling air of the lamp and the local external cooling jet 64 help remove ionization product from the vicinity of the butt weld. This prevents potentially damaging arcs from forming between the area of the butt weld and the cavity wall.

In the preferred embodiment, the R. F. power supply, the details of which are well know to those skilled in the art, delivers pulses of about 100 KV at about 300 watts and a frequency of 2 to 3 Mhz. Referring to FIGS. 2 and 3, the power supply uses a "gap" 58 which is comprised of a high voltage plasma switching device. Briefly, the line voltage is stepped up via a transformer and is used to charge capacitor 60, which in turn feeds the "gap". The output of the "gap" feeds the first few turns of autotransformer 62, the output of which is fed to the electrode. Element 65 is a tuning capacitor. The resulting field which is provided at the bulkhead region has a strength of about 50 megavolts/meter.

There must be some mechanism for ensuring that the field emission source remains in the bulkhead region during lamp operation, or if it migrates, for ensuring that it is returned to the bulkhead region before the next start. To this end, cool air is supplied to the bulkhead region through the hollow electrode. A vortex cooler, which is optional, may be used to supply cool air to the bulkhead region during both staring and steady state operation of the lamp. The air nozzle 64 which is fed by the vortex cooler is shown in FIG. 2, and can be seen to be generally aimed at the bulkhead region. The vortex cooler 66 shown in FIG. 3, is a device which is fed with air at inlet 68, and expels hot air from outlet 70 and cool air from outlet 72. Outlet 72 is connected via a conduit (not shown) with nozzle 64.

If the field emission source migrates from the bulkhead region during operation of the lamp, then a way must be provided to bring it back. In accordance with an aspect of the invention, a thermal pulse is applied to the fill before lamp shutdown. The thermal pulse causes a sufficient amount of the substance that used as a field emission source to be transported back to the bulkhead region, by increasing the mobility of the substance. Then, since the bulkhead has been designed to be the coolest portion of the envelope, the substance will condense at the bulkhead.

In accordance with the preferred embodiment, the thermal pulse is supplied by momentarily interrupting the main cooling to the bulb. When the lamp is turned off (standby mode), the cooling air is momentarily pinched off for a predetermined period of time, e.g., less than five seconds. During this time, the microwave power is on, but at the end of the time, it is switched off and the main cooling is returned to the bulb (as long as lamp remains in standby mode).

Figure 9:
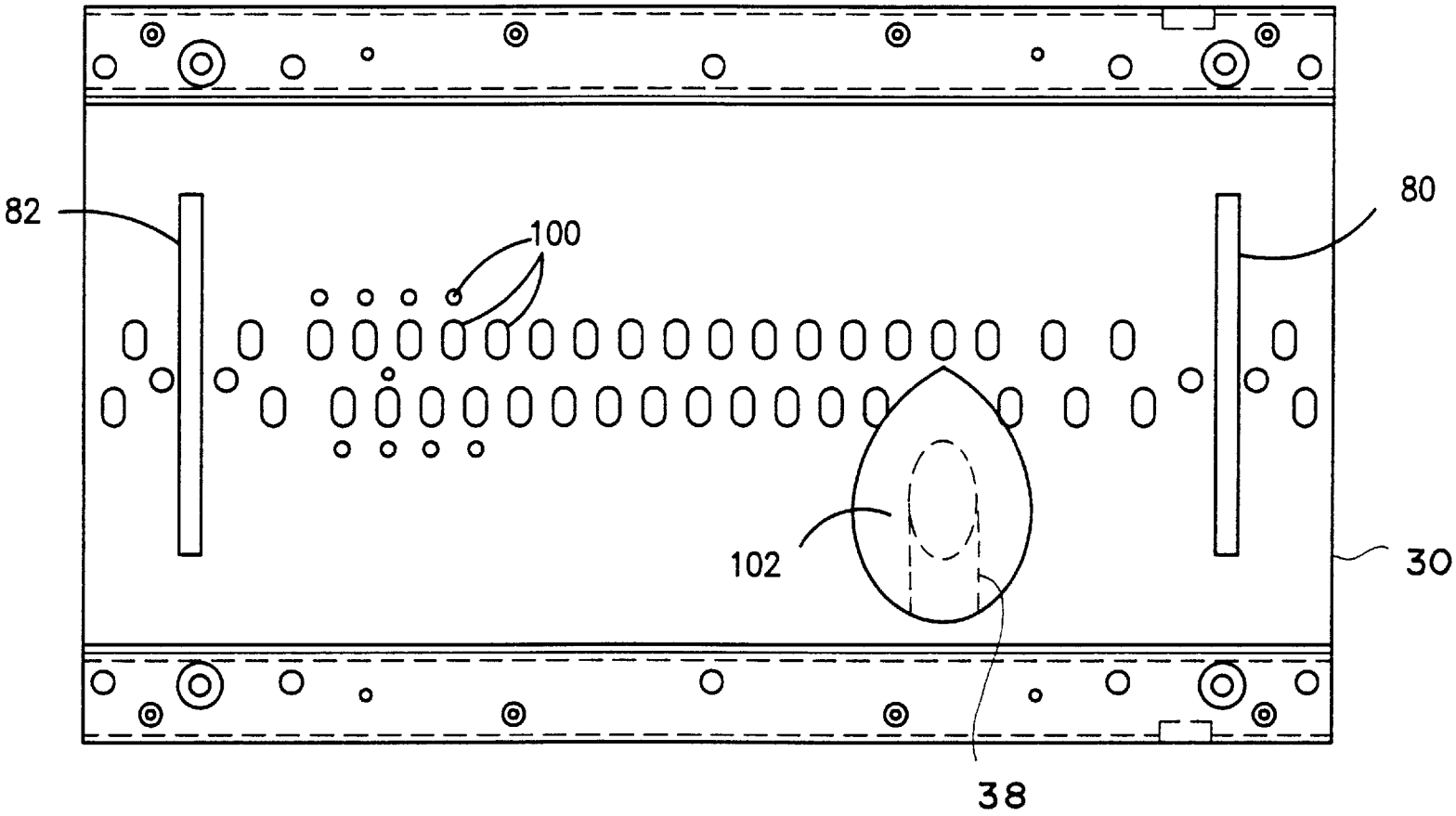
FIG. 9 is a plan view of a reflector.

Referring to FIG. 9, the layout of the reflector 30 is depicted. The particular lamp depicted is powered by two magnetrons, one of which is located at each end, so the reflector has coupling slots 80 and 82 at its respective ends. Perforations 100 are shown for admitting cooling air, while the toroidal jacket 38 is fed through opening 102.

Figure 10:
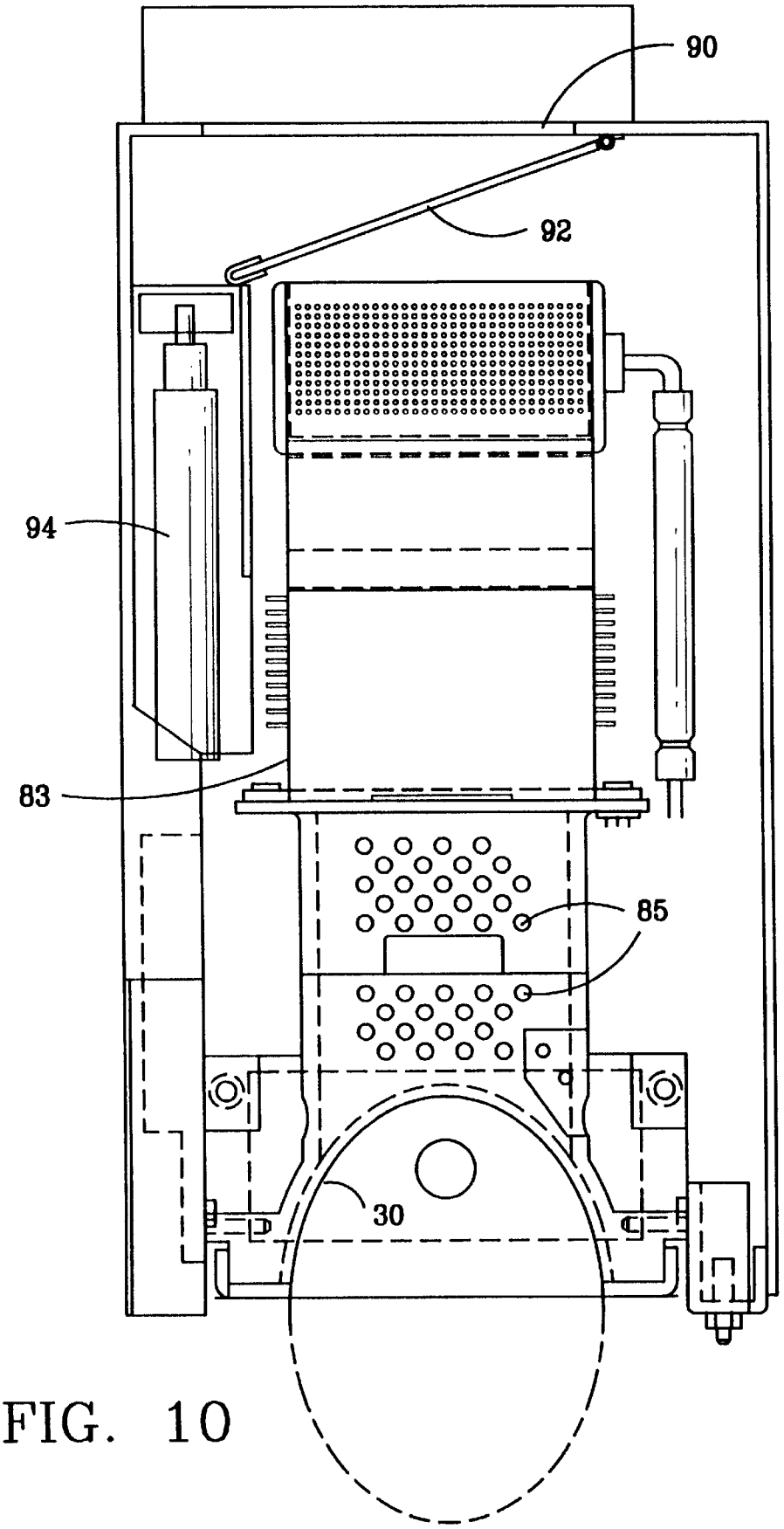
FIG. 10 is a view of a portion of a microwave lamp.

A side view of one of the magnetron housing 83 is shown in FIG. 10. Cooling holes 85 are provided for admitting cooling air to the waveguide which enters the cavity through the coupling slot 102 (see FIG. 9) and perforation 100 for cooling the bulb. Air is pumped into the top of the irradiator through circular opening 90. A pneumatically controlled flap 92 will stop the air flow for the thermal pulse. The thermal pulse is achieved by activating pneumatic activation 94, which moves upwardly to cause the flap 92 to move upwardly to close opening 90. When flap 92 is open, air passes through a plenum chamber, then is forced through the magnetrons. After the air comes out of the magnetrons, it passes into the microwave cavity via holes 85 in the waveguide castings and perforations in the reflector. The air exits the system through the screen.

In the preferred embodiment, the fill in the envelope is an excimer forming fill comprised of xenon and chlorine. In a specific example which has been successfully started by the invention the fill included about 1530 torr of xenon and about 70 torr of chlorine at room temperature. This is a difficult to start fill in that it is at a high pressure and is comprised of electronegative substance. An advantage of excess halogen (over stoichiometric) is that it quenches filamentary discharges, and also provides extra energy at shorter wavelengths.

In the preferred embodiment, the field emission source contains cesium and is the compound cesium chloride (CsCl). In the specific example, about 5 to 200 mg of CsCl may be provided.

The particular salt of cesium which is selected is a chloride, since the excimer radiation is produced by xenon chloride, and the cesium chloride does not significantly contribute to the spectrum of the excimer radiation. In general, it is desirable to select the field emission source so that it does not contribute to the spectrum. This can be accomplished by selecting a field emission source with a high enough melting point that it is not significantly vaporized or mobilized at the normal operating temperature of the bulb wall and not reactive with any of the other bulb constituents, or by selecting a field emission source whose emission lines, are either far removed from the spectral area of interest or the substance is completely ionized. The compound should also be selected so that its melting point is low enough that an amount sufficient to guarantee ignition, can be vaporized by a thermal pulse or other heat producing mechanism at lamp turn-off, so that it can be returned to the bulkhead. In general, the selection of a compound in the general case in accordance with the foregoing criteria is considered to be an aspect of the present invention.

Figure 11:
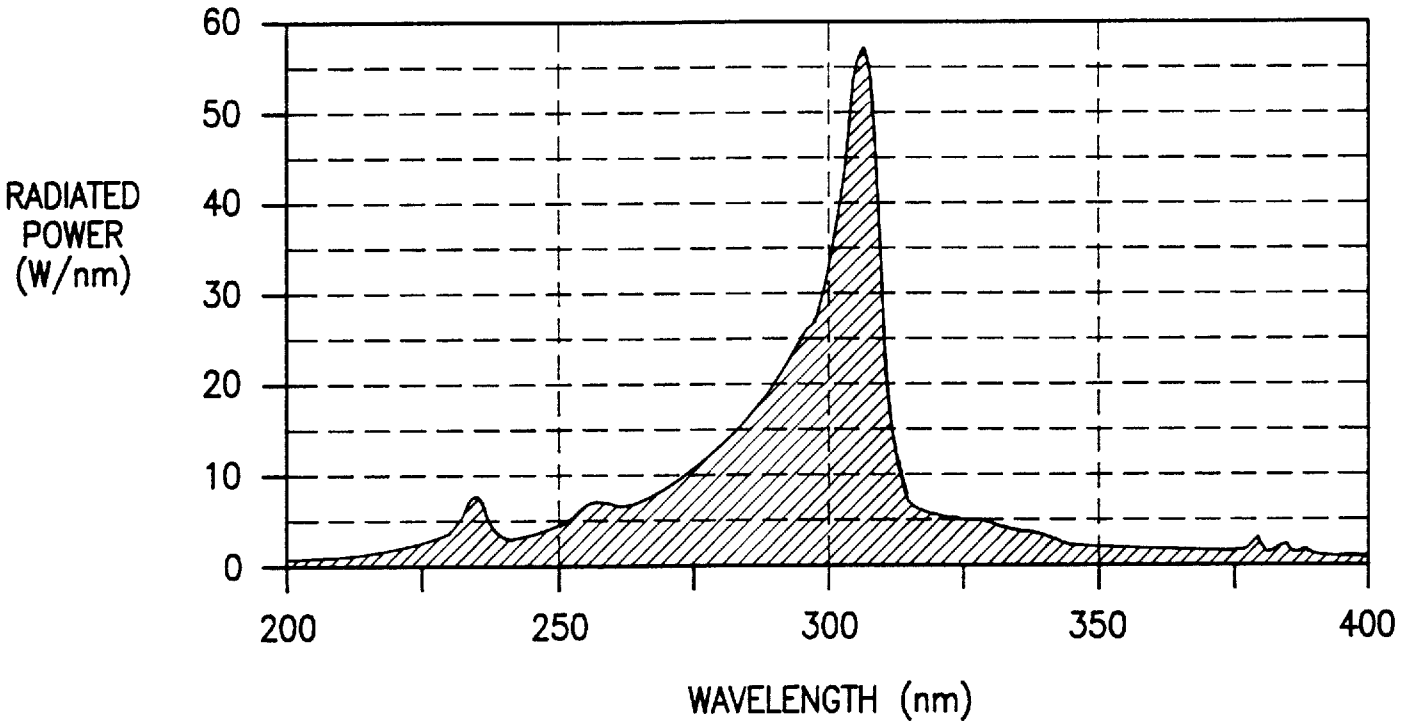
FIG. 11 is a spectral plot of a XeCl excimer lamp.
Figure 12:
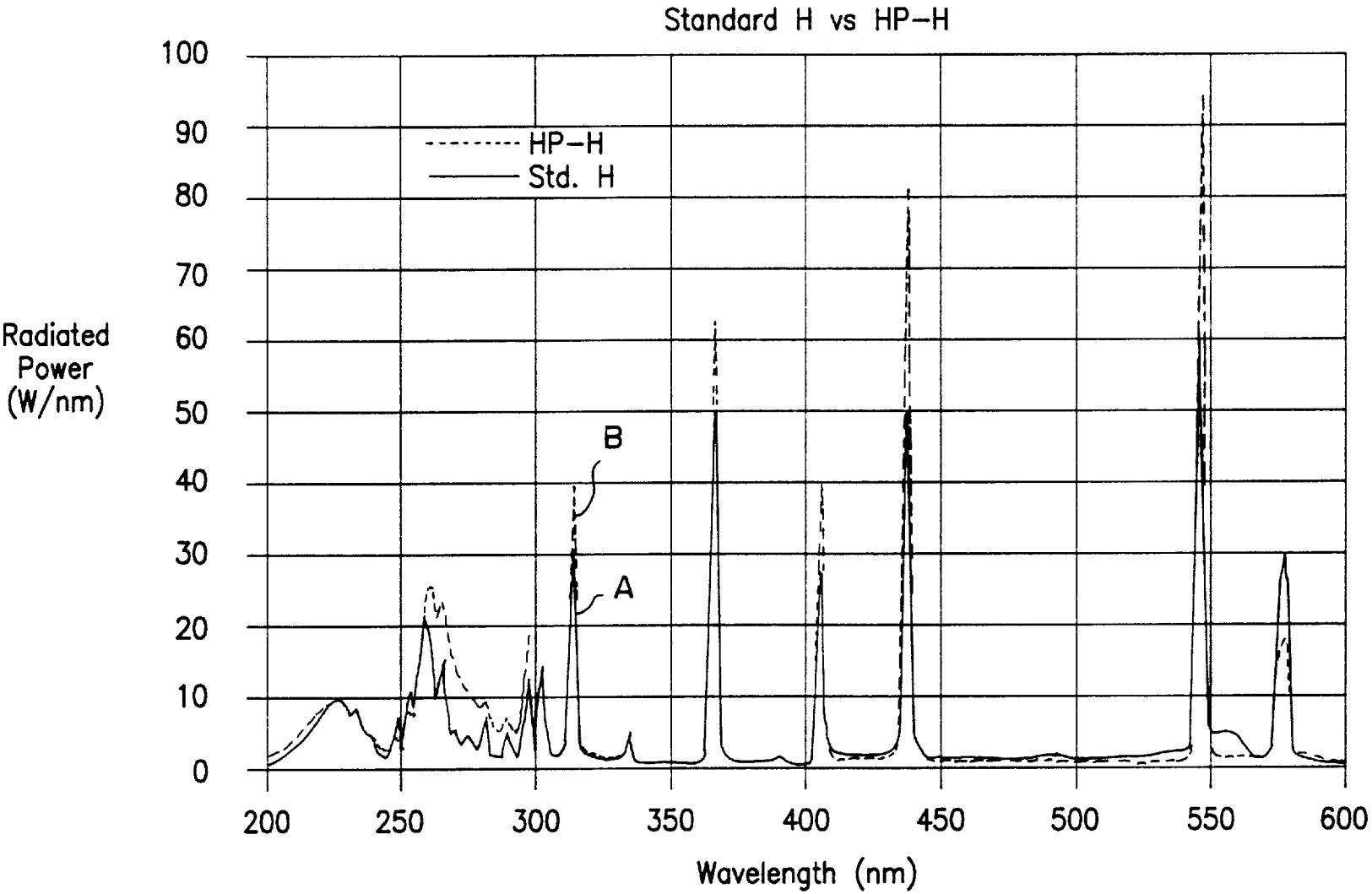
FIG. 12 are spectral plots of mercury based lamps.

In a specific example, 5800 watts of microwave power is coupled to a bulb containing xenon, chlorine, and CsCl as described above, which is ten inches long and 15 mm in internal diameter. The spectrum which is achieved is shown in FIG. 11.

The structure of FIGS. 1 to 10 is broadly applicable to lamps having a variety of difficult to start fills. These include, inter alia, various high pressure rare gas/halogen, halogen only, and rare gas only excimers (e.g., see U.S. Pat. No. 5,504,391, which is incorporated herein by reference) metal/rare gas excimers, thallium xenide excimer, thallium mercuride excimer, and lamps including various molecular emitters. In some types of lamps, the disclosed structure for providing a high starting field will be sufficient to start the lamp without the addition of a field emission source.

A lamp which falls into this latter category is a mercury based ultraviolet lamp having a high pressure rare gas fill, and which also may include metal halide. Mercury based ultraviolet lamps conventionally contain low pressure rare gas fills of the order of a few hundred torr or less. By substantially increasing the rare gas pressure, for example to greater than about one atmosphere at room temperature, substantially greater light output can be obtained. The starting electrode and associated structure illustrated in FIGS. 2 to 9 would be used to provide a high starting field as described above.

FIG. 13 is a comparison of the output of standard mercury based lamp having an argon gas pressure of about 100 to 200 torr at room temperature (solid curve A) with a comparable lamp having a xenon gas pressure of about 1900 torr at room temperature, which is started in accordance with the present invention (dotted curve B). As can be clearly seen, the output of the second lamp (dotted curve B) is substantially greater than the output at the first lamp (solid A). The higher peaks of dotted curve B show that greater output is obtained from the lamp having high pressure rare gas fill.

There thus have been disclosed improved lamps in accordance with the present invention. While the invention has been described in connection with preferred and illustrative embodiments, variations will occur to those skilled in the art, and it is therefore understood that the invention herein is to be defined by the claims which are appended hereto.

We claim:

1. An electrodeless lamp, comprising:

a) an envelope containing a fill;

b) a starting electrode in proximity to a given region of said envelope when the lamp is started;

c) a substance disposed inside said envelope at said given region, said substance containing an element selected from the group of cesium, sodium, potassium, and rubidium, said substance for facilitating the starting of the lamp;

d) starting power source coupled to said electrode for applying an electric field to said substance, said substance being responsive to said electric field to initiate electron emission therefrom to thereby cause a discharge in said fill; and e) excitation power source coupled to said fill to sustain the discharge.

2. The lamp of claim 1, wherein said substance functions as a field emission source and said starting power source causes field emission from said substance.

3. The lamp of claim 1, wherein said starting electrode is switchable between a starting mode where said starting electrode is in proximity to said given region and an operating mode where said starting electrode is disposed away from said given region.

4.The lamp of claim 3, wherein said starting electrode in said starting mode contacts said given region.

5. The lamp of claim 1, wherein said fill is provided with a thermal pulse before the lamp is turned off.

6. The lamp of claim 1, wherein said given region is preferentially cooled to cause said substance to be redeposited at said given region after having been vaporized by the opertion of the lamp.

7. The lamp of claim 1, and further comprising a dielectric surrounding said starting electrode, said dielectric having a dielectric constant greater than the dielectric strength of air.

8. The lamp of claim 7, wherein said dielectric comprises an insulating gas contained in a toroidal jacket.

9. The lamp of claim 7, wherein said starting electrode is hollow for connecting to a source of cooling fluid.

10. The lamp of claim 1, wherein said fill has a pressure at room temperature of at least one atmosphere.

11. The lamp of claim 1, wherein said fill is an excimer forming fill.

12. An excimer lamp, comprising:

a) an electrodeless envelope including an excimer forming fill;

b) an external starting electrode switchable between a lamp starting mode where said starting electrode is in proximity to a given region of said envelope, and a lamp operating mode where said starting electrode is disposed away from said given region;

c) a substance contained in said envelope at said given region for facilitating the starting of the lamp, said substance containing an element selected from the group of cesium, sodium, potassium, and rubidium;

d) starting power source coupled to said electrode in said lamp starting mode to cause application of an electric field to said substance, said substance being responsive to said electric field to initiate electron emission therefrom to thereby cause a discharge in said fill; and e) excitation power source coupled to said fill to sustain the discharge.

13. The lamp of claim 12, wherein said substance functions as a field emission source and said starting power source causes field emission from said substance.

14. The lamp of claim 12, wherein said fill is based on xenon and chlorine and said substance includes cesium chloride.

15. The lamp of claim 12, and further comprising:

a) an insulating gas surrounding said electrode;

b) said electrode is hollow; and c) a source of cooling fluid fed into said electrode towards said given region of said envelope.

16. The lamp of claim 12, wherein said excitation power source is microwave power.

17. The lamp of claim 16, and further comprising a microwave cavity having an opening, said electrode movable through said opening.

18. The lamp of claim 12,wherein said fill has a pressure of at least one atmosphere at room temperature.

19. A microwave powered electrodeless lamp, comprising:

a) a microwave cavity;

b) an envelope disposed in said cavity and containing a discharge forming fill;

c) a metallic probe movable from a first position where said probe is in contact with said envelope at a given region to a second position where said probe is away from said envelope, said probe being in said first position when said lamp is started, said probe being in said second position when said lamp is operating;

d) a substance contained on an interior surface of said envelope at said given region for facilitating the starting of the lamp;

e) starting power source coupled to said probe in said first position to cause application of an electric field to said substance, said substance being responsive to said electric field to initiate electron emission therefrom to thereby cause discharge within said fill;

f) microwave power source coupled to said cavity to sustain the discharge; and g) dielectric disposed between said probe and said cavity, said dielectric having a dielectric strength greater than the dielectric strength of air.

20. The lamp of 19, wherein said dielectric includes an insulating gas surrounding said probe.

21. The lamp of claim 19, and further comprising:

a) a sidearm attached to said envelope;

b) said probe is disposed within said sidearm; and c) a toroidal insulating jacket surrounding said sidearm.

22. The lamp of claim 19, and further comprising:

a) an enclosure defining said cavity; and b) said enclosure includes an opening through which said probe is movable between said first position and said second position.

23. The lamp of claim 19, wherein:

a) said probe is hollow for connecting to a source of cooling fluid;

b) said probe includes a tip in contact with said envelope when in said first position; and c) said tip includes a plurality of radially directed fluid flow openings.

24. A bulb comprising:

a) an electrodeless envelope containing an excimer forming fill; and b) a field emission source disposed within said envelope at a given region for coupling to an exterior source of electric field adapted to cause field emission from said source, said field emission source being responsive to said electric field to initiate electron emission therefrom to thereby cause a discharge within said envelope.

25. The bulb of claim 24, wherein:

a) said excimer forming fill is xenon and chloride; and b) said field emission source is cesium chloride.

26. An electrodeless lamp, comprising:

a) an envelope containing a fill;

b) a starting electrode in proximity to a given region of said envelope when the lamp is started;

c) a field emission source disposed inside said envelope at said given region;

d) starting power source coupled to said electrode for applying an electric field to said field emission source to cause field emission from said source, said field emission source being responsive to said electric field to initiate electron emission therefrom to thereby cause a discharge within said envelope; and e) excitation power source coupled to said fill to sustain the discharge.

27. The lamp of claim 26, and further comprising a source of cooling fluid directed to said given region to cause said field emission source to be re-deposited at said given region after having been vaporized by the operation of the lamp.

28. A method for starting an electrodeless lamp, comprising the steps of:

a) providing a bulb comprised of an envelope and a discharge forming fill in said envelope;

b) providing a field emission source on an interior surface of said envelope at a given region;

c) applying an electric field at said given region to said field emission source, said field emission source being responsive to the electric field to initiate electron emission therefrom to thereby cause a discharge in said fill; and d) coupling a power source to said fill to sustain the discharge.

29. The method of claim 28, wherein said field emission source contains an element from the group of cesium, sodium, potassium, and rubidium.

30. The method of claim 28, wherein said field emission source contains cesium.

31. The method of claim 28, and further comprising the step of preferentially cooling said given region to allow said field emission source to be re-deposited at said given region after having been vaporized by the operation of the lamp.

32. The method of claim 28, and further comprising the step of applying a thermal pulse to said fill before the lamp is turned off.

33. The method of claim 28, wherein said fill is at a pressure of at least one atmosphere at room temperature.

* * * * *